US006057535A

United States Patent [19]

Derobert et al.

[11] Patent Number: 6,057,535

[45] Date of Patent: May 2, 2000

[54] ELECTRIC COOKING OVEN WITH IMPROVED ENERGY DISTRIBUTION

[75] Inventors: Jean-Claude Derobert, Blain sur Orne; Michel Guy De Matteis, Cambes en Plaine, both of France

[73] Assignee: Moulinex S.A., Paris, France

[21] Appl. No.: 09/214,902

[22] PCT Filed: Jul. 11, 1997

[86] PCT No.: PCT/FR97/01283

§ 371 Date: Mar. 24, 1999

§ 102(e) Date: Mar. 24, 1999

[87] PCT Pub. No.: WO98/03041

PCT Pub. Date: Jan. 22, 1998

[30] Foreign Application Priority Data

Jul. 15, 1996 [FR] France ..... 96 08825

[51] Int. Cl.[7] ..... H05B 6/74

[52] U.S. Cl. ..... 219/746; 219/750; 219/756

[58] Field of Search ..... 219/746, 748, 219/750, 751, 747

[56] References Cited

U.S. PATENT DOCUMENTS

| | | | |
|---|---|---|---|
| 2,704,802 | 3/1955 | Blass et al. . | |
| 5,567,339 | 10/1996 | Joo et al. | 219/748 |
| 5,786,579 | 7/1998 | Park | 219/746 |
| 5,828,040 | 10/1998 | Risman | 219/695 |
| 5,874,715 | 2/1999 | Choi | 219/746 |
| 5,935,479 | 8/1999 | Lee | 219/746 |

FOREIGN PATENT DOCUMENTS

| | | |
|---|---|---|
| 0 284 958 | 10/1988 | European Pat. Off. . |
| 0 373 608 | 6/1990 | European Pat. Off. . |
| 0 478 053 | 4/1992 | European Pat. Off. . |
| 0 585 143 | 3/1994 | European Pat. Off. . |
| 0 632 678 | 1/1995 | European Pat. Off. . |

*Primary Examiner*—Teresa Walberg
*Assistant Examiner*—Jeffrey Pwu
*Attorney, Agent, or Firm*—Young & Thompson

[57] ABSTRACT

An electric cooking oven comprising a cooking vessel (1), a microwave energy source and a waveguide (2') substantially parallelepiped in shape delimited transversally by two substantially rectangular surfaces (20', 21') located in two parallel planes separated by a predefined distance (d), the output of guided waves occurring in at least two zones (230, 231) located in an outlet plane (23') perpendicular to the two surfaces and delimited by two parallel edges ($b'_1$, $b'_4$) connecting the two surfaces. The length (1) of the edges is greater than the distance (d) separating the two surfaces (20', 21') so as to optimize the number of excited transversal electric and/or transversal magnetic modes inside the cooking vessel in excitation planes parallel to the outlet plane.

10 Claims, 6 Drawing Sheets

ELECTRIC COOKING OVEN WITH IMPROVED ENERGY DISTRIBUTION

CROSS REFERENCE TO RELATED APPLICATION

This is the 35 USC 371 National Stage of International application PCT/FR97/01283 filed on Jul. 11, 1997, which designated the United States of America.

FIELD OF THE INVENTION

The present invention relates to an electric cooking oven comprising at least one source of microwave energy to deliver to a cooking chamber ultra high frequency waves, by means of a waveguide.

BACKGROUND OF THE INVENTION

A problem generally encountered in cooking with microwaves resides in obtaining a good distribution of the microwave energy in the cooking chamber. Thus, it is known that a stationary microwave arrangement occurs in the cooking chamber during operation of the oven. As a result, the electrical fields of the excited modes in the chamber have nodes and antinodes of voltage to which correspond respectively so-called cold and hot points at different locations in the chamber.

Numerous solutions have already been proposed to improve cooking or reheating of a product (solid or liquid food) by microwave energy.

The first type of solution consists in providing, in a cooking chamber, an agitator for the waves so as continuously to modify the stationary wave regime established in the chamber, thereby to displace the hot points and the cold points.

Another which is very widely used at present, consists in placing the product to be reheated or to be cooked on a turning plate. The relative displacement of the product and the hot points thus permits uniform cooking.

Improvements in the distribution of the microwave energy have also been obtained by supplying the cooking chamber with microwave energy by the bias of two openings provided in one of the walls of the cooking chamber. FIGS. 1 and 2 show schematically the internal portions of a known oven operating according to this principle: in these figures, there is shown a cooking chamber 1 delimited by a back wall 10, a top wall 11, a bottom wall 12 and two side walls 13 and 14. The side wall 13 has two horizontal openings 130 and 131 superposed vertically along the wall 13, for the introduction of microwave energy. The waves are generated by the antenna of a magnetron (not shown), and transmitted to the cooking chamber by means of a waveguide 2. The waveguide 2 has the general shape of a rectangular parallelepiped whose longitudinal axis is vertical. The guide is delimited transversely by two flat rectangular surfaces 20 and 21, perpendicular to the longitudinal axis of the guide and separated by a predetermined distance d defining the length 1 of the guide. These two surfaces define reference planes from which the guided waves are reflected. The two surfaces 20 and 21 are interconnected at a right angle by two rectangular surfaces 22,23, parallel to the side wall 13, each surface having two edges $b_1$, $b_2$, $b_3$, $b_4$ of a length d. The surfaces 22 farthest from the side wall 13 has a lateral prolongation 24 provided with an access opening to receive waves generated by the magnetron antenna. The surface 23 constitutes the output plane for the guided waves and comprises for this purpose two openings 230 and 231 disposed facing the openings 130 and 131. In certain known embodiments, the output plane of the waveguide is directly constituted by a portion of the side wall of the chamber.

SUMMARY OF THE INVENTION

The present invention relates to an improvement in the structure such as described above, which permits obtaining better distribution of the energy within the cooking chamber.

More precisely, the present invention has for its object an electric cooking oven comprising a cooking chamber, a source of microwave energy and a waveguide of substantially parallelepipedal shape, delimited transversely by two substantially rectangular surfaces located in two parallel planes separated by a predetermined distance, the output of the guided waves taking place through at least two regions located in an output plane perpendicular to the two surfaces and delimited by two parallel edges connecting the two surfaces, characterized in that said edges have a range greater than the distance separating the two surfaces, so as to optimize the number of transverse electrical and/or magnetic modes excited within the cooking chamber in the excitation planes parallel to the output plane.

BRIEF DESCRIPTION OF THE DRAWINGS

The invention, as well as the advantages which results from it, will be better understood from the following description, given with reference to the accompanying drawings, in which.

DETAILED DESCRIPTION OF THE INVENTION

Figure 1:
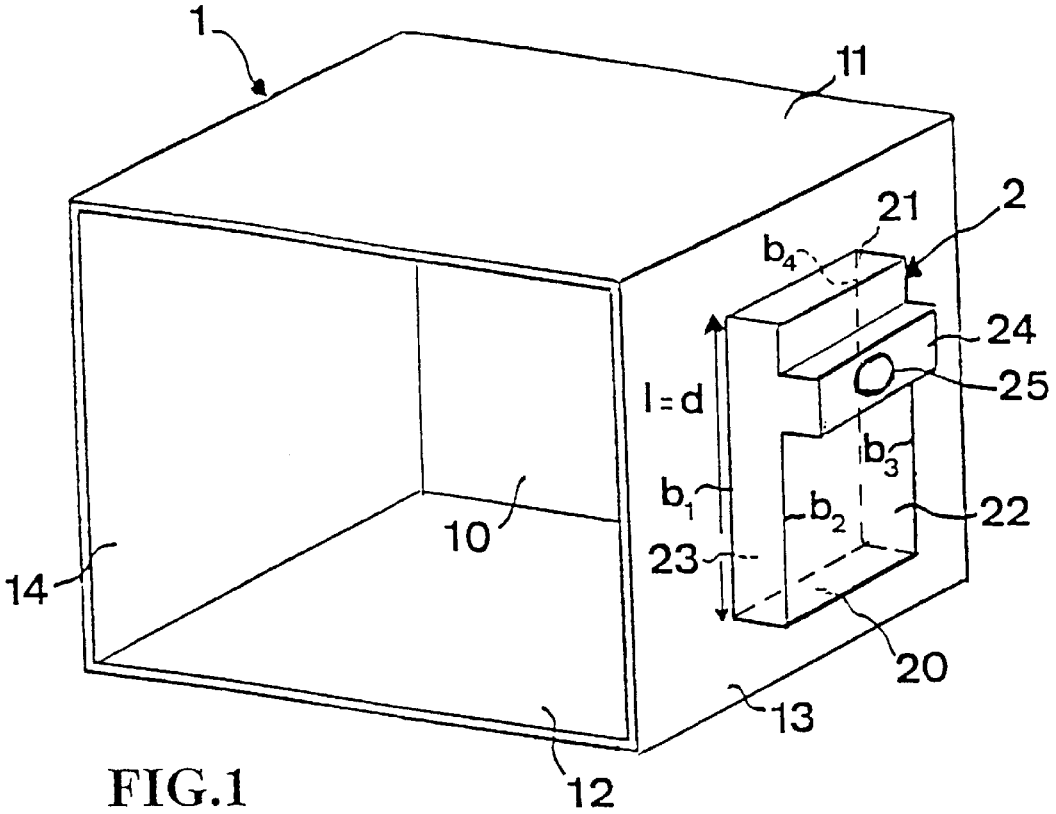
FIG.1 PRIOR ART
FIG. 1 is a schematic perspective view of the association of a cooking chamber and a waveguide according to the prior art.
Figure 2:
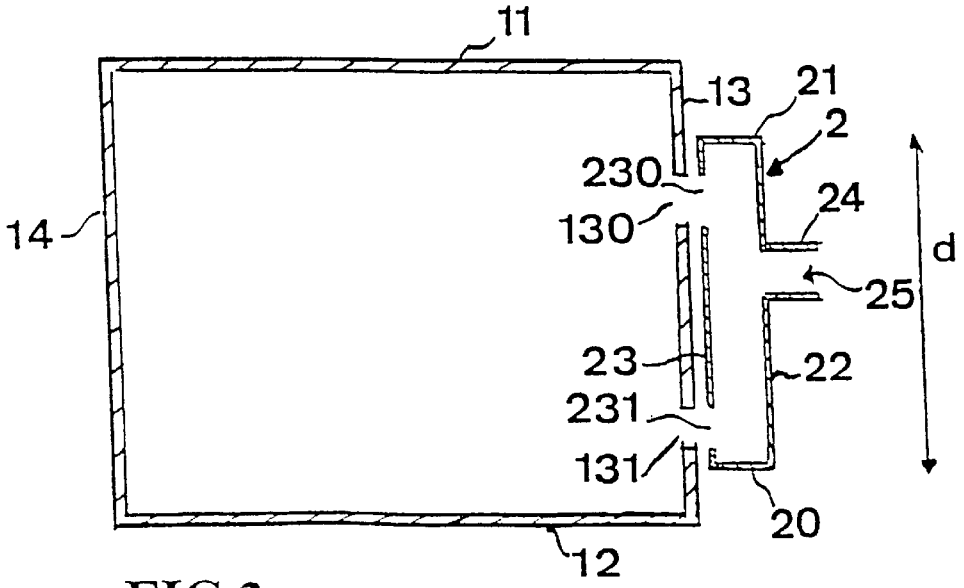
FIG.2 PRIOR ART
FIG. 2 is a cross-sectional view on a vertical plane passing through the middle of the waveguide of FIG. 1.

FIGS. 1 and 2 have already been described in the statement of the prior art. For the following figures, the same reference numerals are used to show the same elements.

Figure 3:
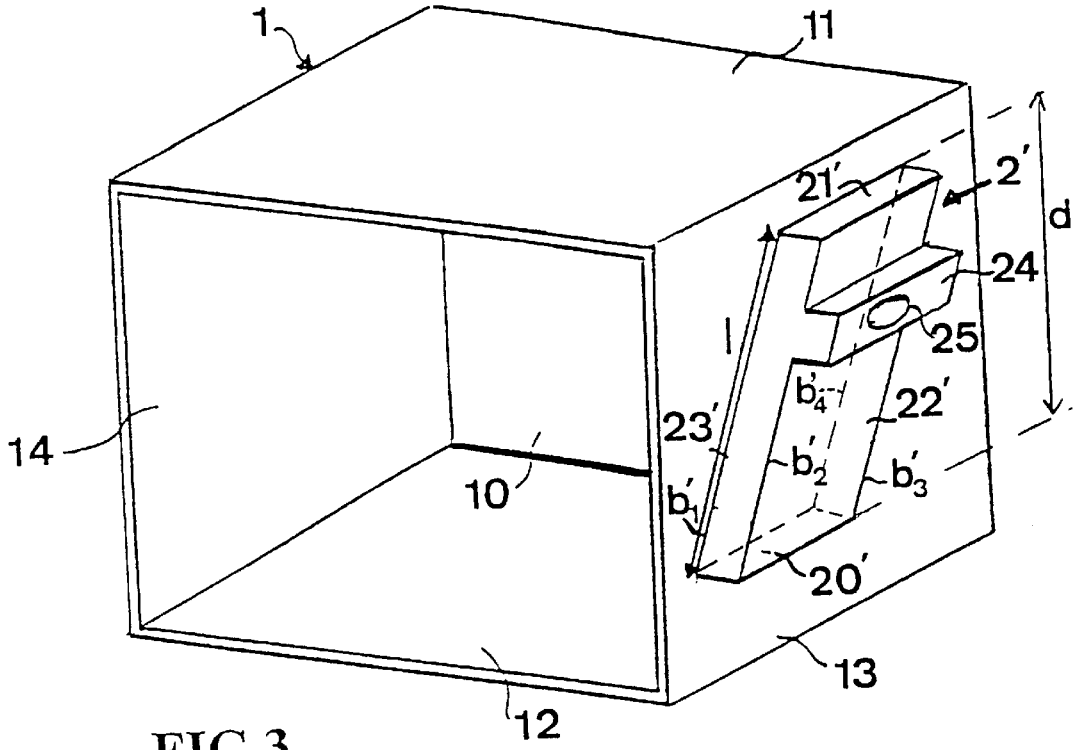
FIG. 3 is a schematic perspective view of the association of a cooking chamber and a waveguide according to a preferred embodiment of the invention.
Figure 4:
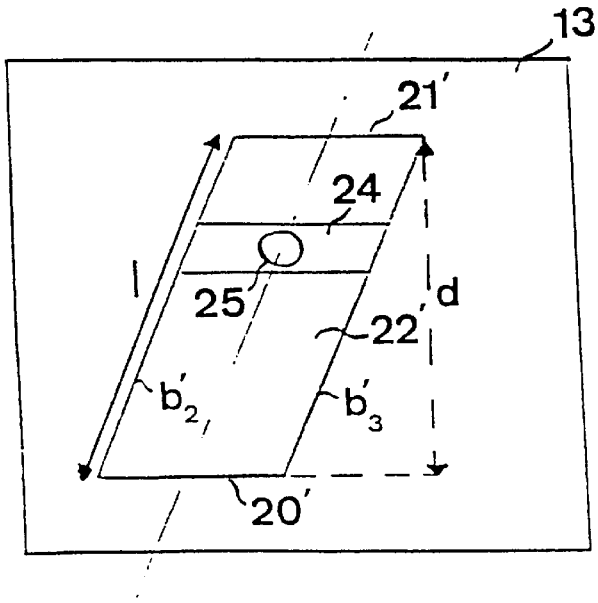
FIG. 4 is an elevational view of the side wall of the chamber of FIG. 3 bearing the guide.

As will be seen in FIGS. 3 and 4, relating to a preferred embodiment of the invention, the waveguide 2'is of substantially parallelepipedal form delimited transversely by two surfaces 20', 21' of substantially rectangular shape, and longitudinally by two surfaces 22' and 23' forming, like the surfaces 22 and 23 of FIG. 1, input and output surfaces of the waveguide. Differently from the waveguide 2 of FIG. 1, however, and according to one essential characteristic of the present invention, the edges $b'_1$, $b'_4$ and $b'_2$, $b'_3$ delimiting respectively the input and output planes 23' and 22' of the guide, connecting the surfaces 20' and 21', have a length 1 greater than the distance d separating said surfaces 20', 21'. The waveguide 2' therefore no longer has the shape of a right parallelepiped, but rather an oblique parallelepiped whose longitudinal axis, parallel to said edges, is inclined relative to an axis orthogonal to the end surfaces 20' and 21'. As a result, for the same distance d separating the two surfaces 20' and 21', the waveguide 2' according to the invention has a length 1 greater than that of the waveguide 2 of FIG. 1, which permits optimizing, as will now be explained, the number of transverse electrical and/or magnetic modes excited within the cooking chamber 1, in planes of excitation parallel to the output plane 23' of the guide.

By way of non-limiting example, let it be supposed in what follows that the dimensions of the cooking chamber are fixed at 33 cm for the width, 34.4 cm for the depth, and 21.2 cm for the height. Given these dimensions, there are theoretically 205 possible excitation modes in the cooking chamber. In reality, a mode in one cavity acts as a pass-band filter whose passing band is about 140 MHz for a central frequency of 2450 MHz. It can be demonstrated under these conditions that only 15 modes can be excited in the cooking chamber. If the respective electrical and magnetic modes are denoted $TE_{mnp}$ and $TM_{mnp}$ with m oscillations along the width of the chamber, n oscillations along the height and p oscillations along the depth, these 15 modes are as follows:

$TE_{033}$ at 2493 MHz,
$TE_{215}$ and $TM_{215}$ at 2465 MHz,
$TE_{224}$ and $TM_{224}$ at 2423 MHz,
$TE_{232}$ and $TM_{232}$ at 2468 MHz,
$TM_{330}$ at 2522 MHz,
$TE_{404}$ at 2519 MHz,
$TE_{422}$ and $TM_{422}$ at 2463 MHz,
$TE_{502}$ at 2434 MHz,
$TM_{510}$ at 2380 MHz and
$TE_{511}$ and $TM_{511}$ at 2419 MHz.

In the preferred embodiment in which the waveguide is disposed on one of the side walls of the chamber, for example the wall 13, the outlet regions of the guide are distributed over the height. To be truly excited, a mode of the chamber located in the excitation planes parallel to the output plane must have one of its voltage antinodes facing an outlet region of the waveguide. As a result, all the modes of the form $TE_{m0p}$ or $TM_{m0p}$ which do not represent antinodes over the height, cannot be excited. Moreover, the modes whose central frequency is too far from the frequency 2450 MHz will be very weakly coupled. It can be demonstrated that the modes that are dominant, which should be excited, are the modes $TE_{033}$, $TE_{215}$, $TM_{215}$, $TE_{232}$, $TM_{232}$, $TE_{422}$, $TM_{422}$.

Figure 5A:
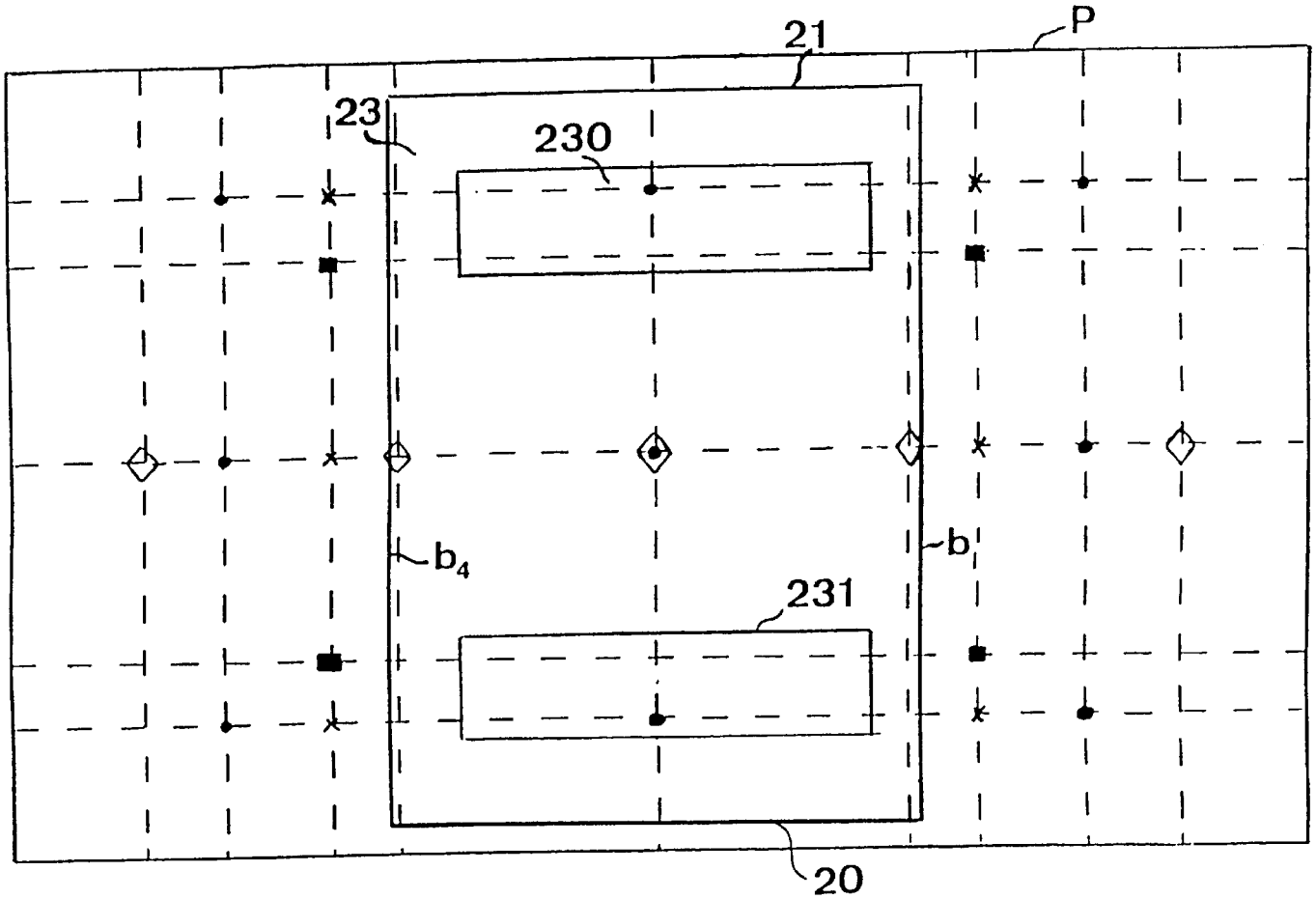
FIG.5a PRIOR ART
FIGS. 5*a* and 5*b* show schematically the number of transverse electrical and/or magnetic fields excited respectively in the case of a waveguide according to the prior art and in the case of the waveguide according to the invention.
Figure 5B:
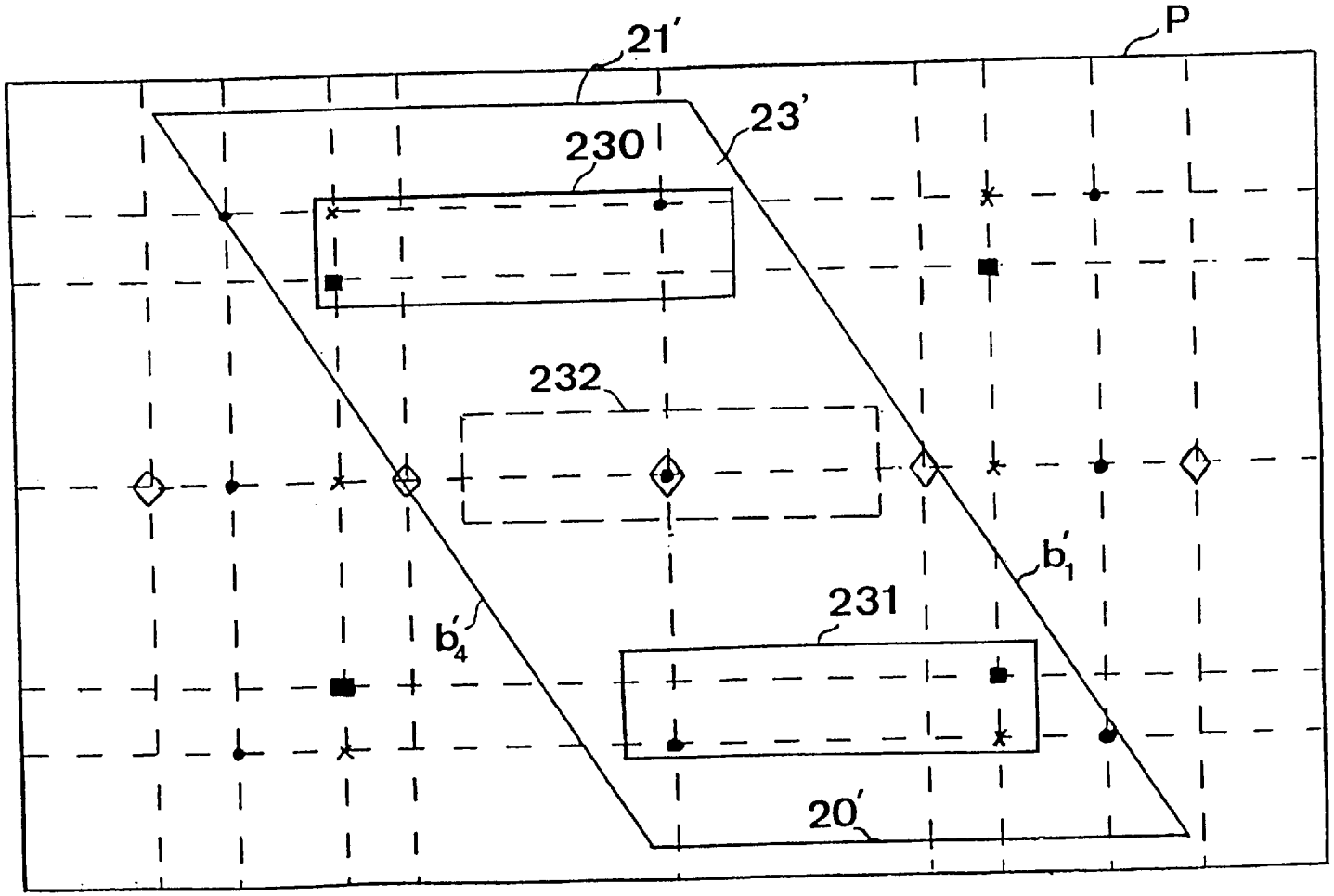

FIGS. 5*a* and 5*b* permit making a comparison between the number of transverse electrical and/or magnetic modes excited by using respectively a waveguide structure of the prior art, and a waveguide structure according to the present invention. In these two figures, the reference P indicates an excitation plane of the modes parallel to the output plane of the waveguides. This excitation plane has the same dimensions as the side wall 13 of the cooking chamber. Within this plane P there is indicated the position of the voltage antinodes for the different transverse electrical modes that it is necessary to excite. These positions are indicated by points for the mode $TE_{033}$, by crosses for the mode $TE_{232}$, by rectangles for the mode $TE_{422}$ and by lozenges for the mode $TE_{215}$. In FIG. 5*a*, there is superposed on the excitation plane P the output plane 23 of a waveguide of the type of that shown in FIG. 1, with two output regions in the form of two rectangular openings 230 and 231, distributed along and centered on the longitudinal vertical axis. It will be recalled that the output plane is delimited in height by the two surfaces 20 and 21, and has two side edges $b_1$ and $b_4$ connecting at a right angle the two surfaces. In this FIG. 5*a*, it will be noted that the output regions 230 and 231 face the two voltage antinodes of the mode $TE_{033}$. As a result, only this mode can be excited in the plane P with the guide structure according to the prior art.

In FIG. 5*b*, the output plane 23' of the waveguide according to the invention is delimited by two edges $b'_1$ and $b'_4$ connecting the surfaces 20' and 21' over a length 1 greater than the distance d separating the two surfaces. With a distribution of the openings 230, 231 according to the height, identical to that of FIG. 5*a*, it will be seen that the openings are at present placed facing the two antinodes of the mode $TE_{033}$, the two antinodes of the mode $TE_{422}$ and the two antinodes of the mode $TE_{232}$. The waveguide schematically shown in FIG. 5*b* thus permits exciting three transverse electric modes. Thanks to the invention, there has thus been optimized the number of modes excited in the excitation plane P, and as a result the distribution of energy within the chamber.

It is possible to improve even further the number of modes excited, by providing, according to the invention, a third opening 232, as shown in broken lines on FIG. 5*b*, this opening 232 being disposed facing an antinode of the mode $TE_{215}$.

In FIG. 5*b*, the oblong openings 230, 231 and 232 have a longitudinal axis extending parallel to the end surfaces 20' and 21' of the guide. Because of the inclination of the longitudinal axis of the guide, a wave which leaves the magnetron antenna does not travel the same distance to reach one or the other end of a same opening. As a result, there is a difference in phase between the ends of one opening. The non-coincidence in phase, of the waves at the ends of one opening, has the result that the electrical field radiated toward the chamber through this opening is not a maximum. In a particularly preferred embodiment of the invention, the oblong openings 230 to 232 are inclined relative to a transverse axis of the output plane 23' parallel to the end surfaces 20' and 21', so as to reduce the difference in distance to be traveled by a wave from the antenna to the two ends of a same opening. The coincidence of the wave incident on the opening will be improved, as will also the radiated power. The coincidence is complete in the case in which the openings are inclined so as to have a longitudinal axis orthogonal to the longitudinal axis of the guide. In practice, the angle of inclination will be chosen to lie in an angular sector delimited by a transverse axis of the plane 23', parallel to the surfaces 20' and 21', and by a transverse axis of the plane 23', perpendicular to the longitudinal axis 25 of the guide.

Figure 7:
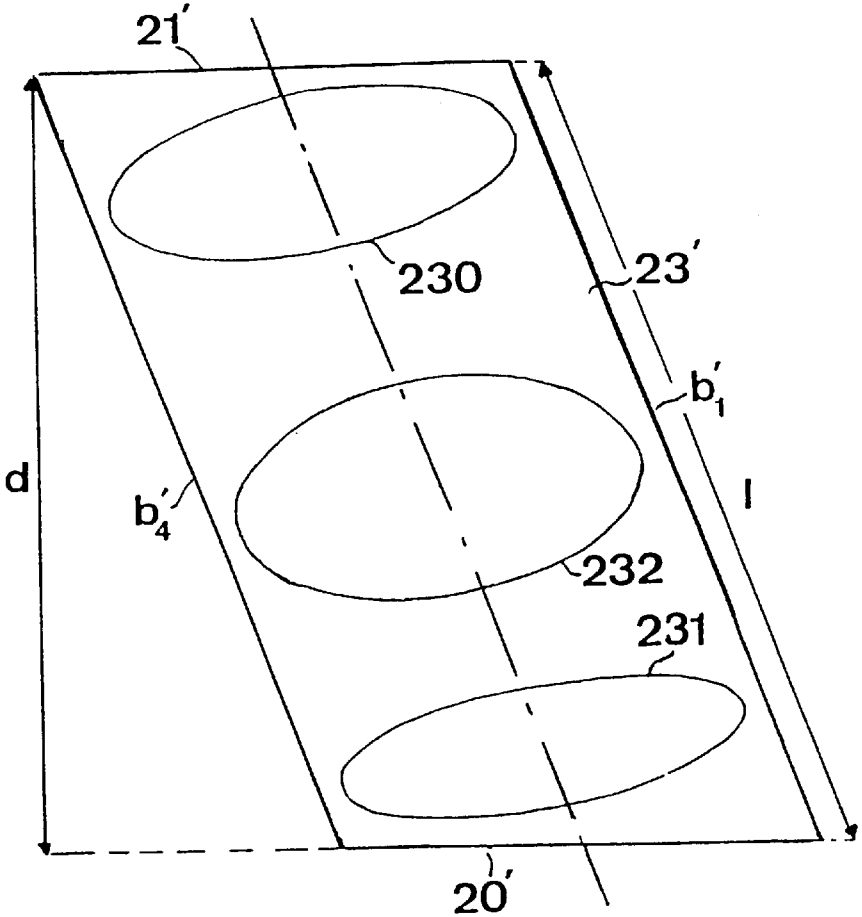
FIG. 7 is a view in elevation of the output plane of the guide of FIG. 6.
Figure 6:
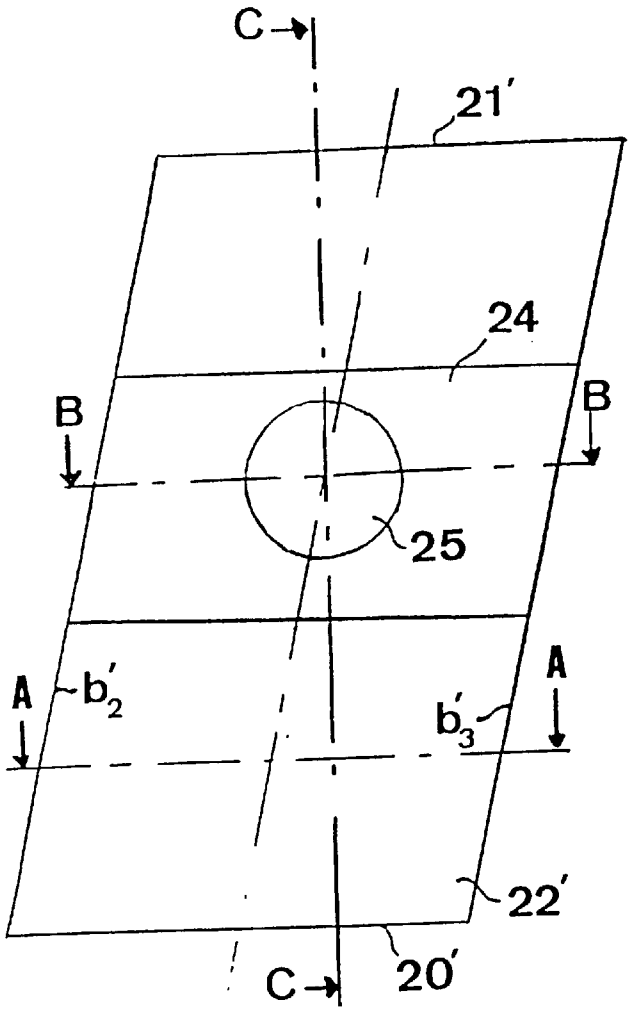
FIG. 6 shows an elevational view of the input side of a waveguide according to a possible embodiment according to the invention.
Figure 8:
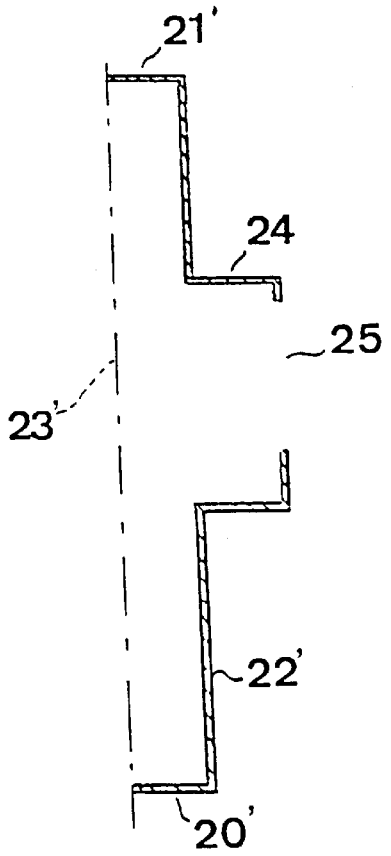
FIG. 8 is a cross-section on the line C—C of FIG. 6.
Figure 9:
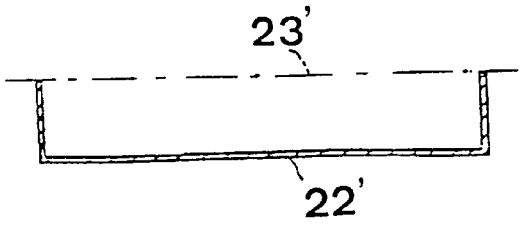
FIG. 9 is a cross-section of the guide on the line A—A of FIG. 6.
Figure 10:
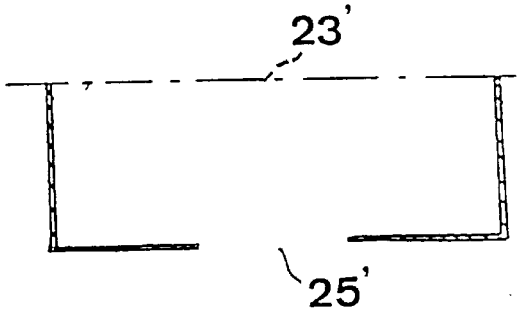
FIG. 10 is a cross-section of the guide on the line B—B of FIG. 6.

According to another preferred characteristic of the present invention, the oblong openings of the output plane of the guide, provided either directly in the wall of the chamber, or in a wall of the guide, have the shape of an ellipse (see FIG. 7). Thus, it can be shown that the field $E_F$ radiated through an oblong opening is expressed by the relation:

$$E_F = \frac{U}{a} \quad (1)$$

in which

U represents the electrical voltage through the opening and a represents the width of the oblong opening.

It is commonly admitted that the voltage U arises as a sinusoidal arc over the length of the opening. In the case of a rectangular opening, the width a is constant over all the lengths of the opening. As a result, according to equation (1), the radiated field EF follows exactly the same law as the voltage. By using an opening of elliptical shape, the width a is almost zero at the ends of the opening and increases toward the center. As a result, the field EF remains substantially constant over the length of the opening. The radiated energy is thus greater in the case of an electrical opening.

There will now be described with reference to FIGS. 6 to 10, a waveguide structure according to the present invention, particularly adapted to an electric oven adapted to receive products to be heated at two distinct levels, a lower level corresponding for example substantially to the level of the bottom of the oven, and a so-called upper level corresponding for example to the mid-height of the cooking chamber.

In the non-limiting example shown, the output plane 23' of the waveguide is directly in the side wall 13 of the cooking chamber, such that FIG. 7 illustrates only the delimitations of the output plane 23' relative to the openings 230, 231 and 232.

The surfaces 20' and 21' of the end of the guide are spaced by a distance d substantially equal to 165 mm, whilst the edges $b'_2$, $b'_3$ or $b'_4$, $b'_1$, separated by a distance substantially equal to 86 mm, have a length 1 of about 178 mm. When the guide is disposed on the side wall of the chamber so that its end surfaces 20' and 21' extend parallel to the bottom and top walls of the cooking chamber, the longitudinal axis of the guide is thus inclined by about 22° relative to the vertical. The center of the opening 25 for the input of waves into the guide is located substantially at a distance of 94.5 mm, in orthogonal projection, from the end surface 20'. The opening 25 has a circular cross-section of a diameter substantially equal to 30.6 mm. The distance of the output plane 23' to the input plane 22' is about 21 mm. The distance from the output plane 23' to the end of the prolongation 24 is about 41 mm. The preceding dimensions permit obtaining a waveguide which will be non-resonant. The wave output takes place at the level of three elliptical openings 230 to 232 (FIG. 7). The intermediate opening 232 is preferably located adjacent the upper level of cooking. In this way, the intermediate opening 232 permits creating, on the one hand with the upper opening 230 and on the other hand with the lower opening 231, two interference zones substantially uncorrelated with each other, and hence less sensitive to a load supplied to each of the two cooking levels. The longitudinal axis of the openings 230 to 232 is for example inclined by 11.5° relative to a transverse axis of the output plane 23' and parallel to the surfaces 20' and 21'. This choice permits obtaining a good compromise between high restituted power and good temperature balance in between the two plates.

The height positioning of the openings is preferably also selected as a function of the position of the voltage antinodes of the modes of shape $TE_{mnp}$ or $TM_{mnp}$, the whole number n, corresponding to the oscillations over height, being equal to 1,2 or 3.

It will be seen moreover that the openings 230, 231 and 232 shown in FIG. 7 have different sizes. This permits preferably maximizing the total power restituted whilst respecting the constraints of impedance adaptation.

What is claimed is:

1. Electric cooking oven comprising a cooking chamber (1), a source of microwave energy and a waveguide (2') of substantially parallelepipedal shape delimited transversely by two substantially rectangular surfaces (20', 21') located in two parallel planes separated by a predetermined distance (d), the output of the guided waves taking place in at least two regions (230,231) located in an output plane (23') perpendicular to the two surfaces and delimited by two parallel edges ($b'_1$, $b'_4$) connecting the two surfaces, characterized in that said edges have a length (1) greater than the distance (d) separating the two surfaces (20', 21'), so as to optimize at least one of the number of transverse electric and magnetic modes excited within the cooking chamber in planes of excitation parallel to the output plane.

2. Electric cooking oven according to claim 1, characterized in that the length (1) is determined such that the regions (230,231) for output of guided waves will be positioned facing a maximum number of voltage antinodes relative to said modes.

3. Electric cooking oven according to claim 1, in which the cooking chamber (1) is delimited by a rear wall (10), a top wall (11), a bottom wall (12) and two side walls (13,14), characterized in that the waveguide (2) is positioned such that the output plane (23') will be parallel to the lateral walls (13,14).

4. Electric cooking oven according to claim 3, characterized in that the cooking chamber (1) is adapted to receive products to be heated at two separate levels, so-called lower and upper, and in that the output plane of the waveguide comprises a third intermediate output region (232) located adjacent the upper level.

5. Electric cooking oven according to claim 4, characterized in that the openings (230, 231, 232) for wave output are distributed along the height as a function of the position of the voltage antinodes of at least one of the transverse electric and magnetic modes.

6. Electric cooking oven according to claim 1, characterized in that it comprises a wall (13,23') connecting the two surfaces (20',21') in the output plane of the waveguide, and in that the regions for guided wave output are connected by oblong openings (230,231, 232) extending transversely relative to a longitudinal axis of the wall parallel to said edges ($b'_1$, $b'_4$), and having a geometric center located on said longitudinal axis of the wall.

7. Electric cooking oven according to claim 6, characterized in that the oblong openings (230,231,232) have a longitudinal axis having an angle of inclination comprised within an angular sector delimited by a transverse axis of the wall (13,23') parallel to the two surfaces (20',21') and by a transverse axis of the wall (13,23') perpendicular to the longitudinal axis of the guide.

8. Electric cooking oven according to claim 6, characterized in that the oblong openings (230,231,232) have the shape of an ellipse.

9. Electric cooking oven according to claim 6, characterized in that the oblong openings have different sizes.

10. Electric cooking oven according to claim 1, characterized in that the distance (d) separating the two surfaces (20',21') is substantially equal to 165 mm, and in that the length of the edges ($b'_1$,$b'_4$) connecting the two surfaces is substantially equal to 178 mm.

* * * * *